US012128325B2

(12) United States Patent
Lackner et al.

(10) Patent No.: US 12,128,325 B2
(45) Date of Patent: Oct. 29, 2024

(54) AMUSEMENT RIDES

(71) Applicants: Johannes Lackner, Dolsach (AT); Hannes Libiseller, Dolsach (AT)

(72) Inventors: Johannes Lackner, Dolsach (AT); Hannes Libiseller, Dolsach (AT)

( * ) Notice: Subject to any disclaimer, the term of this patent is extended or adjusted under 35 U.S.C. 154(b) by 198 days.

(21) Appl. No.: 17/621,081

(22) PCT Filed: Jun. 29, 2020

(86) PCT No.: PCT/EP2020/068221
§ 371 (c)(1),
(2) Date: Dec. 20, 2021

(87) PCT Pub. No.: WO2020/260688
PCT Pub. Date: Dec. 30, 2020

(65) Prior Publication Data

US 2022/0355213 A1 Nov. 10, 2022

(30) Foreign Application Priority Data

Jun. 27, 2019 (GB) ..... 1909285

(51) Int. Cl.
*A63G 27/02* (2006.01)
*A63G 27/00* (2006.01)

(52) U.S. Cl.
CPC ..... *A63G 27/02* (2013.01)

(58) Field of Classification Search
CPC ..... A63G 1/00; A63G 27/00; A63G 27/02
USPC ..... 472/30, 32, 43–47
See application file for complete search history.

(56) References Cited

U.S. PATENT DOCUMENTS 2,294,166 A 8/1942 Eyerly
2,828,128 A * 3/1958 Castille ..... A63G 27/02 472/30
4,007,926 A * 2/1977 Ottaway ..... A63G 27/02 472/3
4,815,728 A 3/1989 O'Keefe
5,558,581 A 9/1996 Knijpstra
(Continued)

FOREIGN PATENT DOCUMENTS

WO 9604051 A1 2/1996

OTHER PUBLICATIONS

International Search Report of Oct. 5, 2020 for PCT/EP2020/068221.
UK Search Report of Dec. 13, 2019 for GB1909285.7.

*Primary Examiner* — Kien T Nguyen
(74) *Attorney, Agent, or Firm* — Christopher M. Ramsey; GrayRobinson, P.A.

(57) ABSTRACT

Arms are mounted opposite one another on a hub carried on a main support tower. The arms rotate around the hub about a first axis. Each arm carries at its outer end a gondola with seats. The arms rotate in a vertical plane so that the gondolas travel in a circular path that has a component of vertical movement. Each gondola has a main support connected to an end of an arm via a motor and bearing, such that the support rotates about a second axis. The support branches out into eight curved branches extending radially outwardly. A seat is mounted at the end of each curved branch via a motor and bearing, such that the seat can rotate about its own axis. Riders are secured safely in the seats by harnesses. The combination of variable rotations about the different axes affords a thrilling ride.

18 Claims, 3 Drawing Sheets

(56) References Cited

U.S. PATENT DOCUMENTS

| | | | | |
|---|---|---|---|---|
| 2004/0198523 | A1* | 10/2004 | Kroon ..... | A63G 27/00<br>473/32 |
| 2006/0035715 | A1 | 2/2006 | Threlkel | |
| 2012/0277009 | A1 | 11/2012 | Kroon et al. | |

* cited by examiner

AMUSEMENT RIDES

CROSS-REFERENCE TO RELATED APPLICATIONS

This is the U.S. National Stage application of International Application No. PCT/EP2020/068221, filed Jun. 29, 2020, which claims the benefit of priority from GB Application No. 1909285.7, filed Jun. 27, 2019. The entire contents of these prior applications are incorporated by reference herein.

FIELD

This relates to amusement rides.

BACKGROUND

Amusement rides have been popular for generations. They range from small and gentle rides for children and families to large and thrilling rides for all. These days, many riders want more and more excitement. Most rides are variations of established principles, but the different variations can provide different and surprising thrills that riders enjoy. Accordingly, there is a perpetual quest for new rides and variations of rides.

BRIEF SUMMARY

Preferred embodiments of the present invention aim to provide amusement rides that can fulfil this need.

According to one aspect of the present invention, there is provided an amusement ride comprising amusement ride comprising:

a rotatable structure that, in use, rotates about a first axis and has a support location that, in use, travels on a path having a component of vertical movement; and a gondola that is supported at said support location and has a plurality of seats for riders:

wherein:

the seats, in use, rotate collectively about a second axis of rotation; and each of the seats, in use, rotates about its own, third axis to rotate the respective rider about that third axis.

Preferably, the rotatable structure comprises an arm that is mounted for rotation about a hub and the support location is located at or adjacent an outer end of the arm.

Preferably, the rotatable structure has two support locations as aforesaid, each with a respective gondola and seats as aforesaid.

The rotatable structure may have more than two support locations as aforesaid, each with a respective gondola and seats as aforesaid.

Preferably, the rotatable structure comprises a plurality of arms as aforesaid, extending radially from said hub.

Preferably, the rotatable structure is disposed substantially upright, so that said path is in a substantially vertical plane.

Means may be provided for selectively tilting said path out of said substantially vertical plane.

Preferably, for a given gondola, said third axes lie in a substantially common plane.

Preferably, for a given gondola, said third axes extend transversely of said second axis.

The seats may face radially outwards from the gondola.

Preferably, a controller, in use, controls rotation of the rotatable structure about said first axis Preferably, a controller, in use, controls rotation of the seats about said second and/or third axes.

The invention extends to a method of operating an amusement ride according to any of the preceding aspects of the invention, comprising the steps of rotating the rotatable structure about said first axis, and rotating or permitting rotation of the seats about said second and third axes.

BRIEF DESCRIPTION OF THE DRAWINGS

For a better understanding of the invention, and to show how embodiments of the same may be carried into effect, reference will now be made, by way of example, to the accompanying diagrammatic drawings, in which.

In the figures, like references denote like or corresponding parts.

DESCRIPTION OF EXAMPLES

Figure 1:
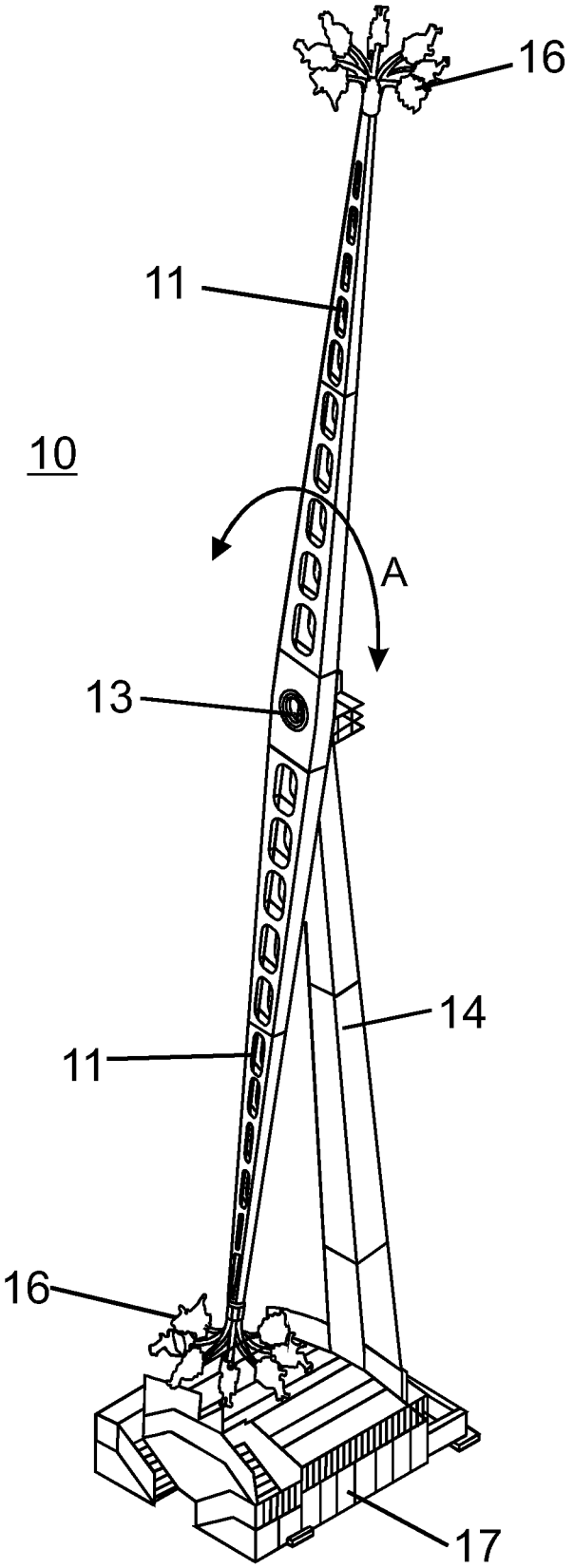
FIG. 1 is a perspective view from one side and above of an amusement ride.

It is to be understood that the various features that are described in the following and/or illustrated in the drawings are preferred but not essential. Combinations of features described and/or illustrated are not considered to be the only possible combinations. Unless stated to the contrary, individual features may be omitted, varied or combined in different combinations, where practical.

Figure 2:
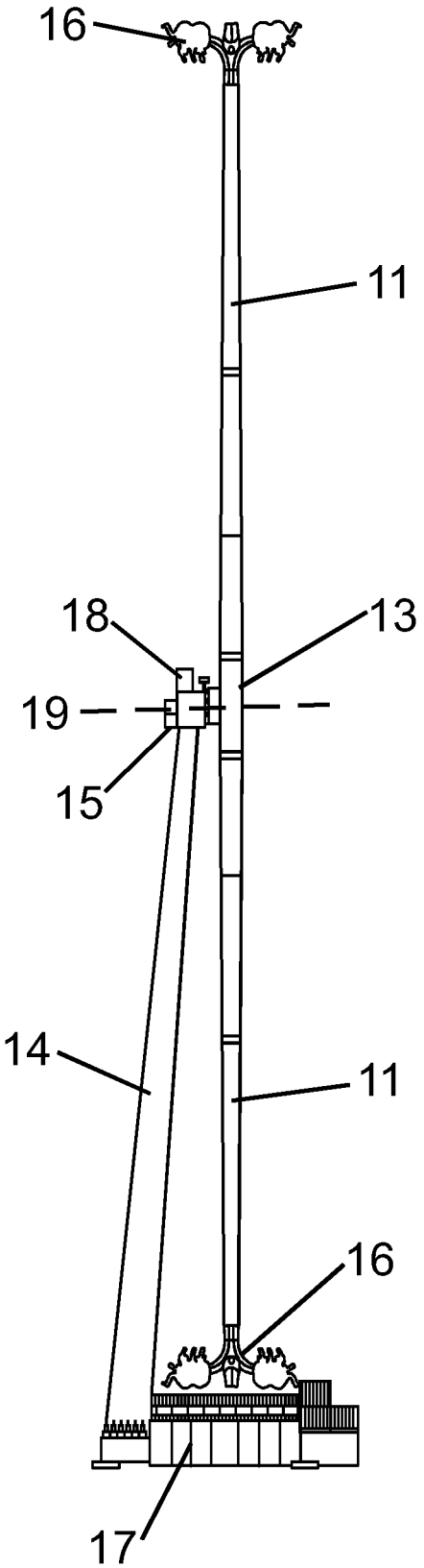
FIG. 2 is a side view of the amusement ride.
Figure 3:
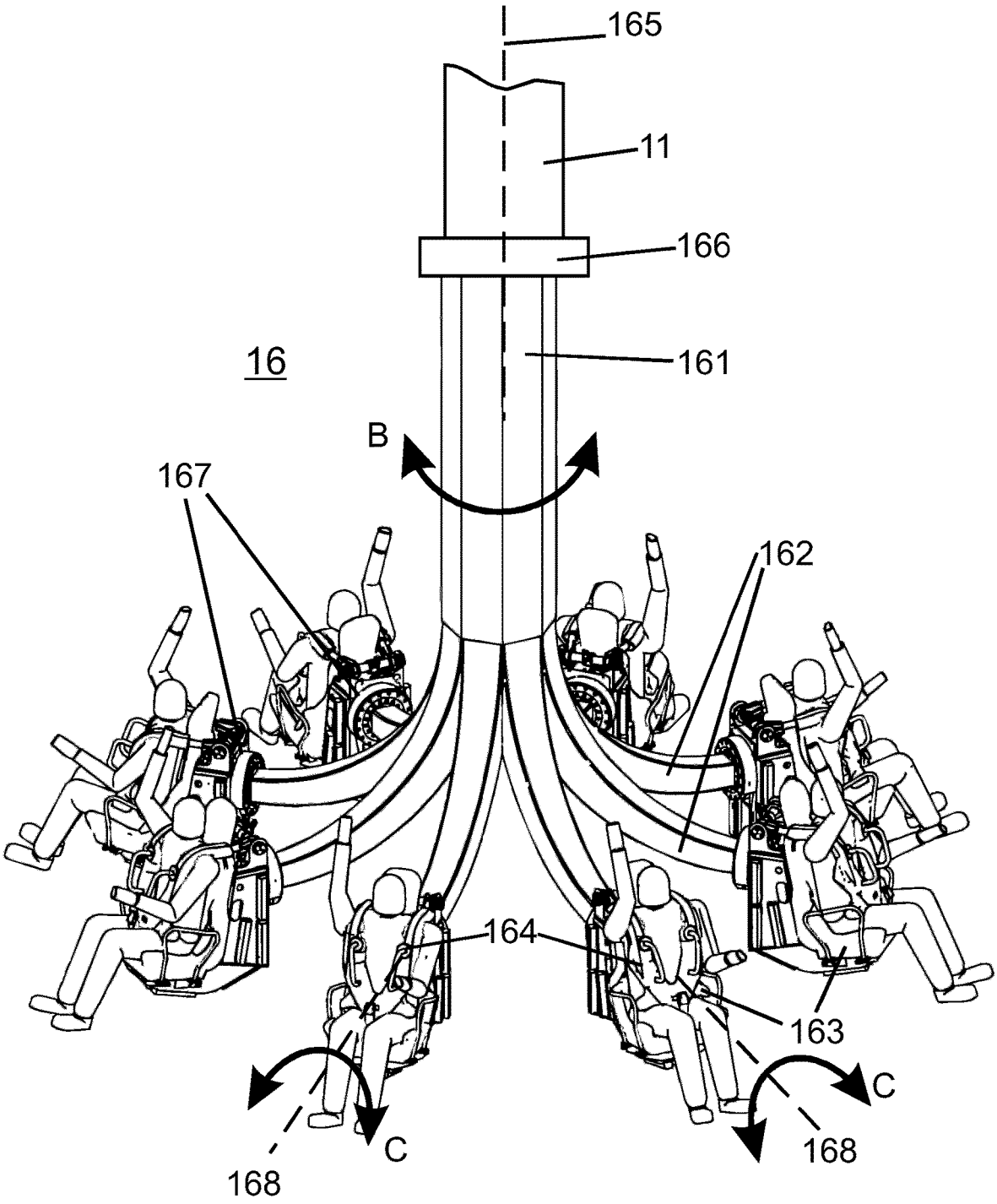
FIG. 3 is a perspective view of a gondola at the end of a rotatable arm of the amusement ride.

The amusement ride 10 that is shown in FIGS. 1 to 3 comprises a pair of arms 11 that are mounted diametrically opposite one another on a hub 13 that is carried on a main support tower 14. A motor 15 controlled by a controller 18 causes the arms 11 to rotate around the hub 13 about a first axis 19, as indicated by arrow A. Each of the arms 11 carries a respective gondola 16 at its outer end. Each of the gondolas 16 has a plurality of seats for riders. The main support tower 14 is secured to the ground or alternative base, where a loading platform 17 is provided for riders to enter or leave from the gondolas 16 when stationary. The arms 11 provide a rotatable structure on which the gondolas 16 are supported, the ends of the arms 11 affording support locations for the gondolas 16.

In this example, the arms 11 rotate in a substantially vertical plane so that, in use, their ends that provide the support locations for the gondolas 16 travel in a circular path that has a component of vertical movement.

One of the gondolas 16 is illustrated in FIG. 3. A main support 161 is connected to an end of a respective arm 11 via a motor and bearing 166, such that the main support 161 may rotate about a second axis of rotation 165, as illustrated by arrow B. The main support 161 branches out into eight (in this example) curved branches 162, each of which extends radially outwardly from the main support 161. At the end of each curved branch 162 there is provided a respective seat 163 that is mounted on the branch 162 via a respective motor and bearing 167, such that the seat 163 can rotate about its own axis 168, as indicated by arrow C. A rider 164 is secured safely in each of the seats 163, by a respective harness.

In use, the arms 11 rotate about the hub 13, affording a first ride sensation to the riders 164. Whilst the arms 11 are rotating, the main support 161 of each of the gondolas 16 is rotated about its axis of rotation 165, by means of the respective motor and bearing 166, affording a second ride sensation to the riders 164. Whilst the main support 161 of each of the gondola 16 is rotating, each of the seats 163 is rotated about axis 168 by its respective motor and bearing 167, affording a third ride sensation to the riders 164.

As will be appreciated, the first, second and third ride sensations are cumulative, such that the path of travel of each rider 164 may be very complex. This complexity may be increased by varying the speed and direction of rotation (clockwise or anticlockwise) of the arms 11 about the hub 13, each main support 161 about axis 165 and each seat 163 about axis 168. Control of speed and direction may be effected manually via controller 18, which controls all motors individually and/or in groups. Additionally or alternatively, controller 18 may effect predetermined ride programs, where speeds and directions of rotation are varied automatically in a predetermined manner.

Each seat 163 may be rotated clockwise or anticlockwise from the point of view of the rider 164. Each seat 163 may be rotated up to a predetermined maximum angle, or may rotate for a full 360° so that, at times, a seat 163 with its rider 164 is upside down, as compared to the view of FIG. 3. The seats 163 may be rotated independently of one another, in unison, or in groups. The seats 163 may be provided with controls that enable riders 164 to control rotation of the seats 163 about axes 168.

An additional element of thrill is preferably added by the scale of the rides 10. For example, the length of each of the arms 11 may be of the order of 30 m. This gives an overall height of the ride 10 of more than 60 m, or around 200 feet. Due to the considerable length of the arms 11, a modest angular speed of rotation of the arms 11 may nevertheless result in a considerable peripheral speed of the riders 164 around the hub 13.

Preferably, the ride 10 has an overall height of at least 30 m, 40 m, 50 m or 60 m.

Figure 4:
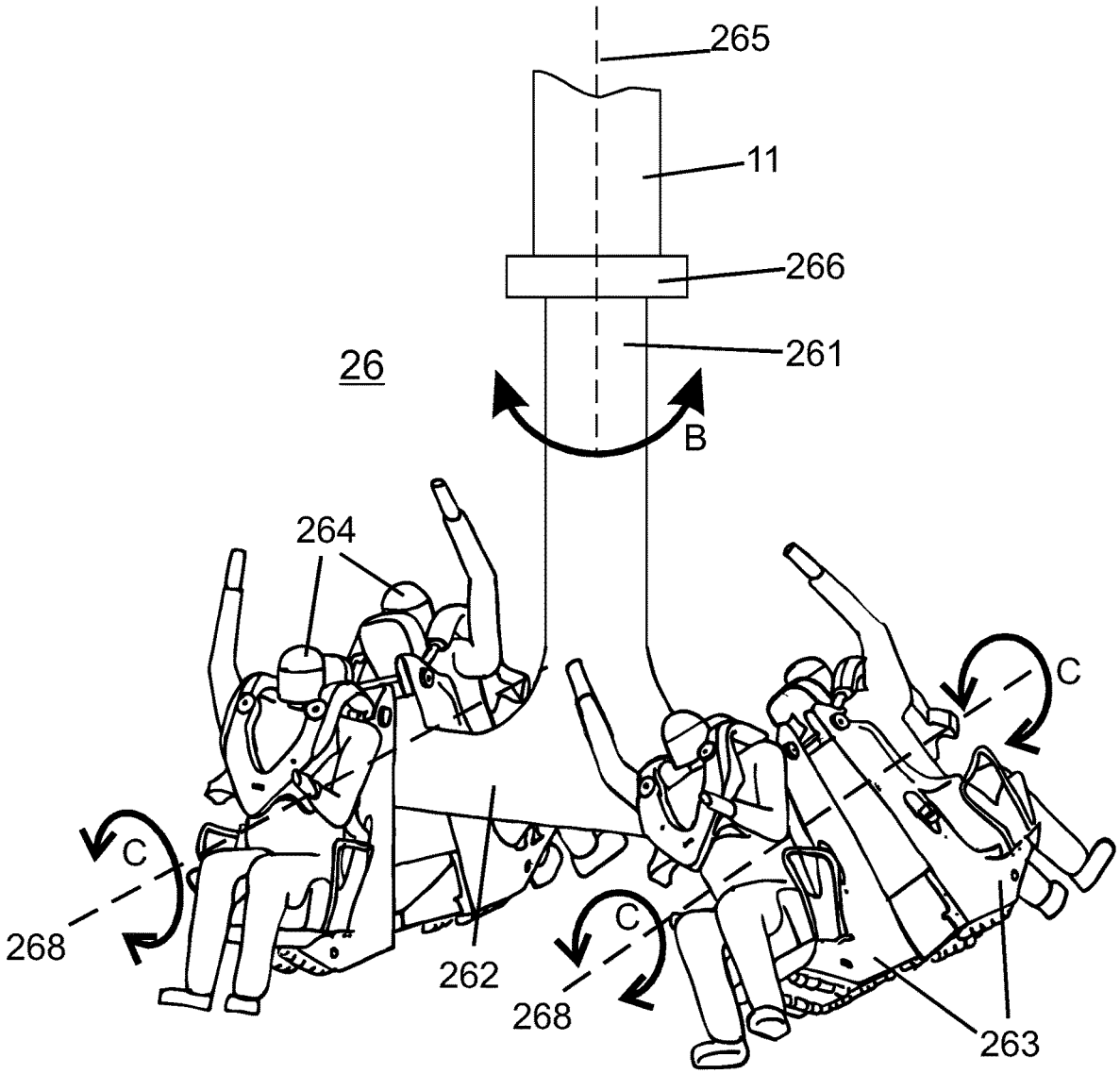
FIG. 4 is a perspective view of an alternative gondola.

The seats of the gondolas may be arranged in alternative configurations. In one such example in FIG. 4, a main support 261 of a gondola 26 is mounted at an outer end of a respective arm 11 for rotation about axis 265 by means of a motor and bearing 266, as shown by arrow B. A respective pair of seats 263 is mounted at the end of each of a pair of branches 262, for rotation about axes 268 by means of respective motors and bearings, as shown by arrows C. In a similar manner to that described above, riders 264 who are secured in the seats 263 by suitable harnesses experience a combination of ride sensations as the various motors are controlled to rotate the arms 11 about hub 13, each of the gondolas 26 about its axis of rotation 265, and each of the seats 263 about axis 268. Whilst, in FIG. 3, each rider 164 faces radially outwardly from the gondola 16, the riders 264 in FIG. 4 face in different directions as each gondola 26 rotates about axis 265.

In a similar manner to the FIG. 3 embodiment, each seat 263 may be rotated clockwise or anticlockwise from the point of view of the rider 264. Each seat 263 may be rotated up to a predetermined maximum angle, or may rotate for a full 360° so that, at times, a seat 263 with its rider 264 is upside down, as compared to the view of FIG. 3. The seats 263 may be rotated independently of one another, in unison, or in groups. The seats 263 may be provided with controls that enable riders 264 to control rotation of the seats 263 about axes 268.

Whilst motor and bearing combinations 166, 167 and 266 are shown and described above, any one or more of them may be replaced by a bearing without a motor. Then the respective gondola 16, 26 is free to rotate about axis 165, 265 under the influence of external forces such as gravity and centrifugal force. And/or the respective seat 163, 263 is free to pivot about axis 168, 268 under the effect of such forces. Each seat 163, 263 may be provided with a simple control to be operated by the rider 164, 264, in order to either permit rotation of the seat 163, 263 about axis 168, 268 or to lock the seat 163, 263 against such rotation.

Whilst two radial arms 11 are provided in the illustrated example, a greater number of radial arms may be provided—for example, 3 or 4. Preferably, they are at equal angular spacings around the hub 13. In a simple option, a single radial arm 11 may be provided. However, this would require a suitable counterbalance for the arm and provide a lower loading factor and therefore lower profitability for the operator.

In a variant, the arms 11 may rotate in a plane that is preferably upright although not vertical. Means may be provided for varying the angle of the plane of rotation to the vertical, whilst the ride is operating.

The main support tower 14 may have an alternative configuration to provide a respective pair of arms 11 at each side of the tower 14 (as seen in FIG. 2), for rotation about a common axis 19. Thus, in effect, a second ride is provided as a mirror image of the first, thereby doubling the capacity of the ride. Also, riders on one ride have the extra sensation of passing swiftly by riders on the other ride. At any given time, the arms 11 on one ride may rotate in an opposite sense to the arms 11 on the other ride.

Amusement rides as above may be embodied as either fixed rides or portable rides. Whilst providing a rotatable support structure by means of arms 11 is an efficient configuration, lending itself readily to assembly, disassembly and transport, rotatable support structures of alternative configurations may be considered.

In this specification, the verb "comprise" has its normal dictionary meaning, to denote non-exclusive inclusion. That is, use of the word "comprise" (or any of its derivatives) to include one feature or more, does not exclude the possibility of also including further features. The word "preferable" (or any of its derivatives) indicates one feature or more that is preferred but not essential.

All or any of the features disclosed in this specification (including any accompanying claims, abstract and drawings), and/or all or any of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An amusement ride comprising:

a rotatable structure that rotates about a first axis of rotation and has a first support location that travels on a path having a component of vertical movement; and a gondola that is supported at said first support location and has a plurality of seats for riders;

wherein:

the seats rotate collectively with the gondola about a second axis of rotation; and each of the seats is spaced from the second axis of rotation and rotates freely about its own, third axis of rotation under the influence of gravity, independently of the rotation of the other seats, to rotate the respective rider about the third axis of rotation.

2. The amusement ride of claim 1, wherein the rotatable structure comprises an arm that is mounted for rotation about a hub and the first support location is located at or adjacent an outer end of the arm.

3. The amusement ride of claim 2, wherein the rotatable structure includes a plurality of the arms and the arms extend radially from said hub.

4. The amusement ride of claim 1, wherein the rotatable structure includes two of the first support locations.

5. The amusement ride of claim 1, wherein the rotatable structure includes more than two of the first support locations.

6. The amusement ride of claim 1, wherein the rotatable structure is disposed substantially upright, so that said path is in a substantially vertical plane.

7. The amusement ride of claim 6, wherein said path is selectively tiltable out of said substantially vertical plane.

8. The amusement ride of claim 1, wherein, for a given gondola, said third axes of rotation lie in a substantially common plane.

9. The amusement ride of claim 1, wherein, for a given gondola, said third axes of rotation extend transversely of said second axis.

10. The amusement ride of claim 1, wherein the seats face radially outwards from the gondola.

11. The amusement ride of claim 10, wherein each of the seats is mounted at an end of a respective arm that extends radially outwards from the gondola.

12. The amusement ride of claim 1, further comprising a controller that controls rotation of the rotatable structure about said first axis of rotation.

13. The amusement ride of claim 1, further comprising a controller that controls rotation of the seats about said second axis of rotation and/or said third axis of rotation.

14. A method of operating an amusement ride of claim 1, the method comprising rotating the rotatable structure about said first axis of rotation, and rotating or permitting rotation of the seats about said second axis of rotation and third axis of rotation.

15. The amusement ride of claim 1, wherein each third axis of rotation passes through a back of the respective seat.

16. An amusement ride comprising:

a hub;

an upright arm that is mounted for rotation about the hub, about a first axis of rotation;

a gondola that is mounted at an end of the arm for rotation about a second axis of rotation that extends along the arm;

a plurality of radial arms that extend radially outwards from the gondola;

a plurality of rider seats that are mounted on the gondola, each of the rider seats being mounted (a) at an end of a respective one of the radially extending arms and (b) for independent rotation about its own, third axis of rotation that extends transversely of the second axis of rotation:

wherein, in use:

the arm rotates about the hub, about said first axis of rotation;

the gondola with the rider seats rotates about said second axis of rotation; and each of the rider seats rotates independently about its own, third axis of rotation under the influence of gravity, independently of the rotation of the other seats, to rotate the respective rider about the third axis of rotation.

17. The amusement ride of claim 16, wherein each third axis of rotation passes through a back of the respective seat.

18. The amusement ride of claim 17, having two arms as aforesaid, each mounted for rotation about the hub with a respective gondola and seats as aforesaid.

* * * * *